US006403184B1

(12) United States Patent
Michlin

(10) Patent No.: US 6,403,184 B1
(45) Date of Patent: Jun. 11, 2002

(54) PROCESSABLE LAMINATED FORM

(76) Inventor: Irving R. Michlin, 253 David Rd., Salt Point, NY (US) 12578

( * ) Notice: Subject to any disclaimer, the term of this patent is extended or adjusted under 35 U.S.C. 154(b) by 0 days.

(21) Appl. No.: 09/334,030

(22) Filed: Jun. 15, 1999

(51) Int. Cl.[7] ..... G09F 3/00

(52) U.S. Cl. ..... 428/40.1; 40/299; 283/81; 283/101; 283/105; 283/114; 428/41.8; 428/41.9; 428/42.1; 428/42.2; 428/42.3; 428/43; 428/213; 428/219; 428/220

(58) Field of Search ..... 428/40.1, 41.9, 428/41.8, 42.1, 42.2, 42.3, 43, 213, 219, 220; 283/81, 101, 105, 114; 40/299

(56) References Cited

U.S. PATENT DOCUMENTS 5,582,433 A * 12/1996 Sisson ..... 283/81
5,591,290 A * 1/1997 Walter ..... 156/152
5,958,536 A * 9/1999 Gelsinger ..... 428/40.1
6,135,507 A * 10/2000 Hamby ..... 283/81

FOREIGN PATENT DOCUMENTS

JP 5-50537 * 3/1993

* cited by examiner

*Primary Examiner*—Nasser Ahmad
(74) *Attorney, Agent, or Firm*—Francis C. Hand, Esq.; Carella, Byrne et al.

(57) ABSTRACT

A laminated form is made of multiple plies which are laminated together. One or both of the outer plies is die-cut to form a plurality of spaced apart or contiguous removable labels. Each label has one portion on the underside provided with a pressure-sensitive adhesive to allow the label to be temporarily attached, for example, to a page of a catalog. The adhesive-free portion of each label may be held in place in the form by ties or by adhesive on the opposed ply with a barrier coat therebetween. The labels may be disposed in a random pattern on each ply with suitable software provided to image the labels in distinct manners.

32 Claims, 2 Drawing Sheets

PROCESSABLE LAMINATED FORM

This invention relates to a processable laminated form. More particularly, this invention relates to a laminated form containing removable labels which can be selectively imaged.

BACKGROUND OF THE INVENTION

As is known, various types of laminated paper constructions have been employed to provide a user with labels that can be attached to various types of substrates such as documents, pages in a magazine, message boards and the like. Typically, such laminated constructions are made of two plies, one of which is die-cut to form a plurality of labels while the other acts as a carrier sheet to which the die-cut sheet is peelably secured so that the die-cut labels can be removed from the carrier sheet and applied to a substrate.

In order to be applied to a substrate, an adhesive is applied to the back of each label which is of a type to be peeled from the carrier sheet while remaining on the label. Various types of barrier coatings have also been provided on the carrier sheet to allow release of the labels with sufficient adhesive on the backs of the labels to allow the labels to be applied to a substrate.

The labels which are removed from the above type of laminated constructions typically have an adhesive over the entire back surface so that the label can be applied directly to a substrate and, particularly, within the peripheral confines of the substrate. Accordingly, when such labels are applied to different pages of a multi-page document, the labels are hidden from view.

It has also been known from U.S. Pat. No. 4,188,250 to form a composite web of pressure sensitive labels in which the web has a web of supporting material and a series of two-part labels releasably secured by pressure-sensitive adhesive to the supporting material web. Each two-part label is separated by a line of perforation with one part provided on the underside with adhesive and the other part being free of adhesive. The labels are used for retail purposes so as to be applied to consumer goods so that the part of the label with the adhesive carries a price for the item while the remaining tear off part of the label carries a discounted price for purposes of a sale.

SUMMARY OF THE INVENTION

It is an object of the invention to provide a laminated form for supplying a plurality of removable labels each of which can be easily handled and subsequently affixed at one end to a substrate.

It is another object of the invention to provide a processable laminated form which can be selectively imaged to provide labels which can be applied to multi-page documents in an observable manner.

It is another object of the invention to be able to supply a plurality of removable labels on a laminated form which can be selectively imaged in various types of imaging machines.

It is another object of the invention to provide a form which can be used by a retailer for inclusion in a mailing whereby removable labels may be used by the customer as a premium to mark items or to write notes.

It is another object of the invention to provide a mail order company with a form which can be included with a delivery of merchandise to provide a customer with a letter of gratitude and removable labels to tag pages of a mail order catalog for subsequent orders.

It is another object of the invention to provide a laminated form of removable labels which may be printed with variable graphics.

Briefly, the invention provides a processable laminated form comprising two plies, for example of paper, which are laminated together and which are of a suitable size, such as 8½ inches by 11 inches for processing through imaging machines such as laser printers, ink jet printers and the like.

In accordance with the invention, at least one of the two plies has a plurality of die-cut areas therein to define a plurality of removable labels in the ply. In one embodiment, only one ply is die-cut to provide a multiplicity of labels. In another embodiment, both plies are die-cut with each ply providing multiple labels. In addition, in this embodiment, the die-cut areas are offset relative to each other from one ply to the other ply.

Further, in accordance with the invention, an adhesive, such as a moderately tacky pressure sensitive adhesive, is disposed on only a portion of the underside of each label, i.e. the side facing the other ply. For example, only one half of the back side of a label is provided with the adhesive. The adhesive is characterized in being of a type to remain on the label upon removal of the label from the underlying ply whereby the removed label is adherable to a substrate. That is to say, the adhesive remaining on the label is sufficient to permit adhesion of the labels to a substrate. In this respect, each label may be used to flag a page of a catalog or any document, multi-page or otherwise, since the label is free to project beyond the periphery of the page. The projecting portion of the label does not carry any adhesive which might otherwise interfere with use of the label.

In one embodiment, the processable form also includes a barrier layer, for example a silicon barrier layer, between the adhesive containing portion of each label and the opposite ply. This barrier layer ensures that the adhesive on the label remains on the label when the label is removed from the form for a subsequent use.

In another embodiment, a fugitive glue is disposed between the adhesive-free portion of each label and the opposed ply to releasably secure the label to the opposed ply. In this embodiment, the fugitive glue serves to hold the labels within the plane of the ply in which the label is formed during processing, for example, over rollers in an imaging machine which might otherwise bend the labels during imaging process.

As an alternative embodiment, a pressure sensitive glue may be used in place of the fugitive glue to hold the adhesive-free portion of each label to the opposed ply.

The laminated form may also employ a plurality of rupturable tabs (i.e. "perforations") to secure the periphery of the adhesive-free portion of each label to the remainder of the ply in which the labels reside.

The laminated form may also be constructed so that one ply of the form is of a heavier weight than the other ply. For example, a ply containing the labels may be made of 24 pound weight while a ply not containing labels is made of 20 pound weight.

The laminated form provided by the invention may be processed through imaging machines so that imaging may be placed on the face of one or more of the plies and in particular on the labels.

The laminated form can be processed in various types of imaging equipment, for example a laser printer, so that information may be imaged onto each removable label. Further, information may differ from label to label.

Further, in another embodiment, the removable labels may be disposed in a non-parallel relation to each other so that different images may be presented in a different pattern to the reader. In such cases, software may be provided to allow a selective rotation and/or inverting of fonts to give maximum flexibility of design.

The laminated form may be preprinted or furnished blank to a user so that either a portion or all of the forms can be printed from an imaging process.

BRIEF DESCRIPTION OF THE DRAWINGS

These and other objects and advantages of the invention will become more apparent from the following detailed description taken in conjunction with the accompanying drawings wherein.

DETAILED DESCRIPTION

Figure 1:
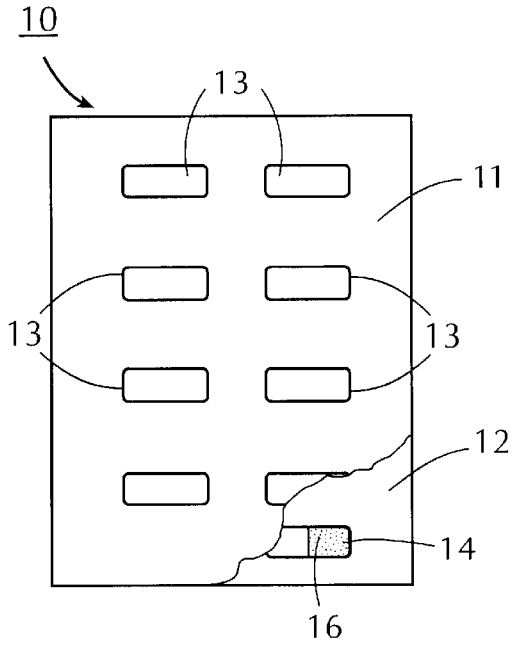
FIG. 1 illustrates a front view of a laminated form constructed in accordance with the invention.
Figure 2:
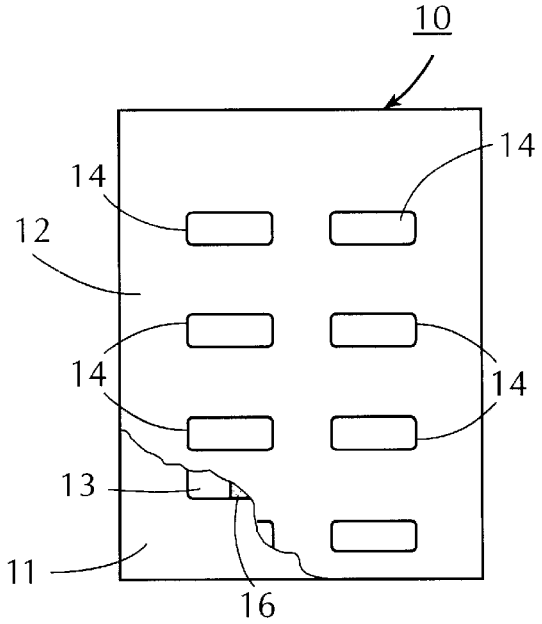
FIG. 2 illustrates a rear view of the laminated form of FIG. 1 in accordance with the invention.

Referring to FIGS. 1 and 2, the processable laminated form 10 is of two-ply construction having a front ply 11 and a back ply 12 laminated to and co-extensive with the front ply 11. In this respect, the two plies 11, 12 may be made of separate sheets which are laminated together or may be made of a single sheet which is folded over onto itself. For purposes of this description, the term "ply" is used generically to define separate sheets which are laminated together or a single sheet which is folded over and laminated.

The laminated form 10 is generally of a size to pass through a printer, for example 8½ inch by 11 inch, A4, and the like. However, the form may be made in any suitable size which can be imaged in a suitable imaging machine, such as a laser printer, ink jet printer and the like.

As illustrated in FIG. 1, the front ply 11 has a plurality of die-cut areas therein to define a plurality of spaced apart removable labels 13. Likewise, as shown in FIG. 2, the back ply 12 has a plurality of die-cut areas to define a second plurality of spaced apart removable labels 14. As indicated, the die-cut areas in each ply 11, 12 are in off-set relation to the die-cut areas of the other plies 11, 12.

Figure 3:
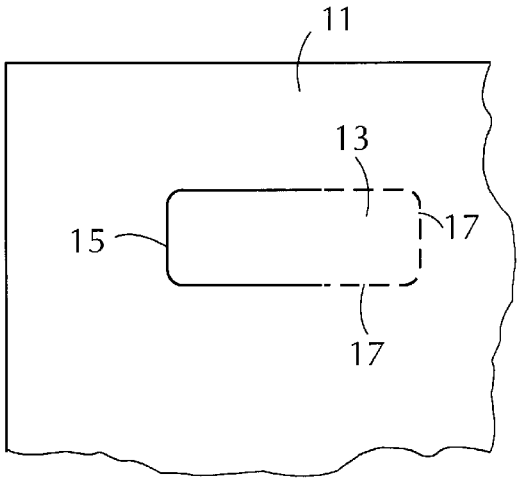
FIG. 3 illustrates a partial view of the form of FIG. 1.
Figure 4:
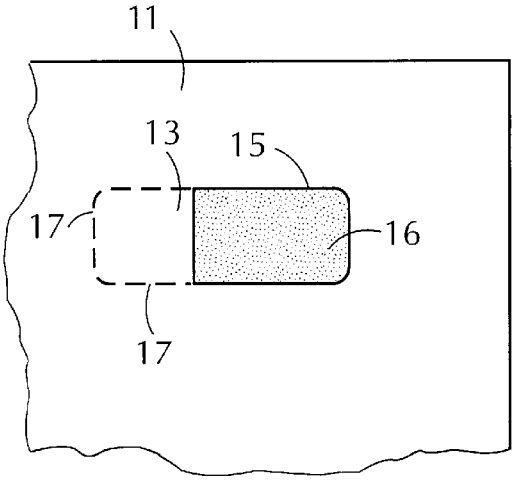
FIG. 4 illustrates a partial view of the back side of a label formed in the top ply of the form of FIG. 1.

Referring to FIG. 3, each label 13 is defined in the front ply 11 by a die cut 15 which defines a rectangular frame. In addition, as illustrated in FIG. 4, a moderately tacky pressure sensitive adhesive 16 is disposed on only a portion of the underside of each label 13, which portion faces the opposed ply 12 (see FIG. 2). By way of example, the adhesive 16 is confined to the right-hand half portion of the label 13 as illustrated in FIG. 4. The remaining portion of the label 13 is adhesive-free.

The adhesive 16 which is used on each label 13 is characterized as a type which remains on the label 13 upon removal of the label 13 from the front ply 11 in order to permit removable adhesion of the removed label to a substrate (not shown). Typically, the label 13 would be removed from the form 10 by grasping of the non-adhesive portion and applied to a substrate with the adhesive-free portion of the label 13 projecting or not from the substrate. For example, the label 13 may be used to tag a page in a catalog. After use, the label may be peelably removed from the substrate and either re-used or discarded.

The plies 11, 12 of the form 10 outside of the label areas are laminated to each other using a different adhesive from that as used on the labels 13, 14. For example, the plies 11, 12 are laminated together using a permanent pressure sensitive adhesive. Alternatively, while it is possible to use a moderately tacky pressure sensitive adhesive to laminate the two plies 11, 12 together, this has the disadvantage that the plies may become separated from each other rather than the intended labels.

While the laminated form 10 is illustrated as having labels 13, 14 on two sides, the form 10 may be constructed so that the labels are contained only in one of the two plies 11, 12. Further, the labels 10 may be contiguous in one or both plies 11, 12.

As illustrated in FIG. 3, die cut 15 which defines each label 13 also defines small rupturable ties or perforations 17 which serve to hold the adhesive-free portion of the label 13 to the remainder of the ply 11. Thus, the form 10 may be processed through imaging equipment, and particularly around rollers, such as in laser printers, ink jet printers and similar imaging devices without the adhesive-free portion of the labels 13, 14 becoming free and otherwise projecting from the respective plies 11, 12. Thus, the rupturable ties 17 serve as a means to hold the adhesive free portion of the label 13 in place.

Alternatively, the labels 13, 14 may be die-cut so that the adhesive-free portions are entirely free of the remainder of the respective plies 11, 12. In this case, a barrier coat may be applied to the adhesive-free portion while a fugitive glue or a pressure-sensitive glue (not shown) is disposed on the facing ply 12, 11, respectively in order to releasably secure the adhesive free portion of the label to the respective ply 11, 12.

Figure 7:
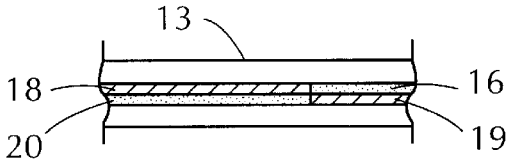
FIG. 7 illustrates a cross-sectional view of a modified form in accordance with the invention.

As indicated in FIG. 7, a label 13 may be provided with adhesive 16, as above, on one portion and a barrier coat 18 on the remaining portion. The opposed ply would be provided with a barrier coat 19 facing the adhesive 16 while a removable adhesive 20 faces the barrier coat 18.

Alternatively, a barrier coat may be printed on the back of each label 13 in the area that is not intended to have adhesive while the entire label 13 is provided with the pressure-sensitive adhesive 16. When the label 13 is removed from the form 10, the adhesive 16 will only be on that portion that is not printed with the barrier coat. However, the entire label 13 would be held securely in place in the form 10 during handling and imaging.

The laminated form 10 may also include a barrier coat or layer such as a silicone, on a respective ply 11, 12 in facing relation to the moderately tacky pressure sensitive adhesive 16 on the opposite ply 11, 12 to ensure removal of the adhesive 16 with the labels 13, 14.

The laminated form 10 can be constructed so that one ply is of heavier weight than the other. For example, where the labels are used in only the front ply 11, the front ply 11 may have a stock weight of 24 pounds while the backing ply 12 is of 20 pound stock weight.

In still another embodiment, the form may be made of three plies with the central ply being formed as a carrier sheet and the outer plies being die cut, as above, to have labels formed therein.

As noted above, the laminated form 10 may be preprinted or furnished blank to a user. Likewise, either a portion or all of the form 10 may be printed from an imaging process.

During an imaging process, each label 13 may be imaged with the same or different information. Further, the labels 13 in the front ply 11, and the labels 14 in the back ply 12 can be imaged at the same time using duplex techniques or in a sequential manner.

After the laminated form 10 with the imaged labels 13, 14 is provided to a user, the user may select one or more of the labels for removal. At this time, the adhesive-free portion of the selected label 13, 14 is lifted from the remainder of the ply 11, 12 by breaking the rupturable ties or perfs 17 therebetween (see FIG. 3). The remainder of the labels can then be broken out of the ply via the perforation 15 provided by the die-cut. The adhesive portion of the removed label may then be used to temporarily affix the label to a calendar, a page in a book, a page in a catalog and the like.

The labels 13, 14, once removed from the laminate 10 may also be used for other purposes, for example, for messages, for posting on a message board, for marking purposes and the like.

Figure 5:
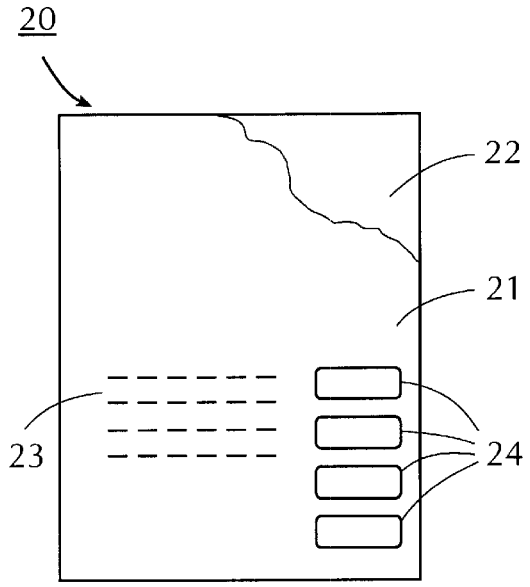
FIG. 5 illustrates a modified embodiment of a laminated form having a message conveying portion in accordance with the invention.

Referring to FIG. 5, the laminated form 20 is constructed as above with two plies 21, 22 which are laminated together in a co-extensive manner. As illustrated, the front ply 21 has an image receiving portion to receive message information 23 and a plurality of die-cut areas separate from the imaging receiving portion to define a plurality of spaced apart or contiguous removable labels 24 along one side of the form 10. As above, an adhesive is disposed on only one portion of each label 24 in facing relation to the second ply 22.

Alternatively, the removable labels 24 may be disposed in other areas, such as in the lower half of the ply 21.

In this embodiment, the laminated form 20 may be imaged by a user to send a message to a customer with removable labels 24 which can be used as a premium or for marking the pages of a catalog. For example, a mail order company may include such a form 20 in a delivery of merchandise so that the customer receives a letter of gratitude for entering an order as well as removable labels which can be used to tag different pages of the mail order catalog for subsequent orders. Further, one or more of the labels may be provided with imaging indicating that use of the labels on a follow-up order or bounce-back order entitles the customer to a discount or rebate or to suggest purchase of specific merchandise.

Figure 6:
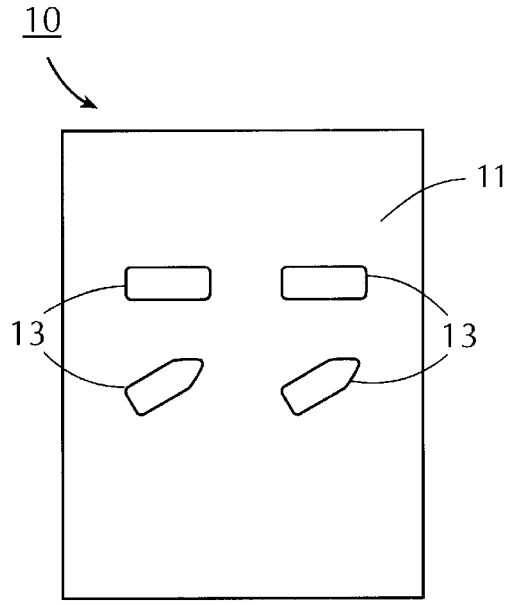
FIG. 6 illustrates a front view of a laminated form having die-cut areas disposed in non-parallel relation to each other in accordance with the invention.

Referring to FIG. 1, the labels 13 are disposed in parallel relationship. However, as indicated in FIG. 6, wherein like reference characters indicate like parts as above, the laminated form 10' may be constructed so that the die-cut areas are disposed in non-parallel relation to each other in order to define spaced apart labels at angles to each other. Further, the labels may be rectangular as illustrated in FIGS. 1 and 2 or may be provided with a triangular shape at one end as indicated by the labels 13' in FIG. 6 or other overall shape. The shaped end may be provided with the adhesive while the remaining portion of the label is adhesive-free or vice-versa.

The invention thus provides a laminated form which may be used by a small office and/or home office for personalization of the form and the removable labels and for subsequent use of the labels to mark or attach to a substrate. The laminated forms may also be used in the promotional market and in particular for short-run direct mail. In this case, the forms may be personalized with the name of a prospect and may be included as a premium in a mailing piece.

Still further, the laminated form may be used in the novelty-hobby product market. For example, the laminated form may be packaged for resale through retail outlets along with a graphics software package. This could possibly incorporate cartoon characters and other clip art.

The software used to image the labels may use a template for a standard configuration. In the case where the labels 13' are provided in a non-parallel relation to each other, the software used to image the labels would have a suitable template for rotating and/or inverting fonts to apply the imaging to the respective labels.

The laminated glue which is used to laminate the plies of the laminated form may be a hot melt adhesive, for example, sold under the product designation HL-2203-X by the H.B. Fuller Company. The barrier coat may be of any suitable silicone material, such as a GE silicone sold under the designation UV 9400 Solventless Polymer by General Electric Company, Waterford, N.Y. The pressure sensitive adhesive which is used on the back of the labels may be a pressure sensitive UV curable adhesive sold under the designation Craiglam 1029 LT by Craig Adhesives & Coatings Company of Newark, N.J.

The form may be constructed in the following manner.

First, a web of paper is generated and passed through a first station in which a barrier coat is applied to the top surface of the web at the appropriate places. Next, the web is passed through a second in which the adhesive 16 is applied. Thereafter, the web is passed through a third folding station in which the web is folded on itself about a longitudinal axis. The thus folded web is then forwarded to a fourth station wherein the die cuts 15 are made in one or both sides of the traveling web to form the various labels. Finally, the traveling web is forwarded to a fifth station in which the web is cut and trimmed into the two-ply forms 10 so that the two-plys appear as one sheet. For example, the forms 10 are cut and trimmed into an 8½ inch×11 inch size.

What is claimed is:

1. A processable laminated form comprising a first ply;

a second ply permanently adhesively laminated to said first ply;

at least one of said plies having a plurality of die-cut areas therein to define a plurality of spaced apart removable labels in said one ply; and a removable pressure sensitive adhesive disposed on only a first portion of each respective label facing the other of said plies, said adhesive remaining on said respective label upon removal of said respective label from said one ply whereby said removed label is adherable to a substrate.

2. A processable form as set forth in claim 1 which further comprises a barrier layer between said adhesive-containing portion of each respective label and said other ply.

3. A processable form as set forth in claim 2 which further comprises a fugitive glue between the remaining portion of each respective label and said other ply to releasably secure said respective label to said other ply.

4. A processable form as set forth in claim 2 which further comprises a pressure-sensitive glue between the remaining portion of each respective label and said other ply to releasably secure said respective label to said other ply.

5. A processable form as set forth in claim 1 wherein each said ply has a plurality of die-cut areas therein to define a plurality of spaced apart removable labels in each said ply.

6. A processable form as set forth in claim 5 which further comprises a barrier layer between said adhesive-containing portion of each respective label and said other ply.

7. A processable form as set forth in claim 6 which further comprises a fugitive glue between the remaining portion of each respective label and said other sheet to releasably secure said respective label to said other ply.

8. A processable form as set forth in claim 5 which further comprises a barrier coat on the remaining portion of each respective label and a pressure sensitive glue on said other ply to releasably secure said remaining portion of said respective label to said other ply.

9. A processable form as set forth in claim 1 wherein said one of said plies is of heavier weight than said other of said plies.

10. A processable form as set forth in claim 1 wherein at least one of said plies has imaging on a face thereof.

11. A processable form as set forth in claim 1 further comprises a plurality of rupturable ties securing a second portion of each label separate from said first portion to the remainder of said one ply.

12. A processable form as set forth in claim 1 wherein said die-cut areas are disposed in parallel relation to each other in said one ply.

13. A processable form as set forth in claim 1 wherein at least some of said die-cut areas are disposed in non-parallel relation to each other in said one ply to define labels at angles to each other.

14. A processable laminated as set forth in claim 1 further comprising a third ply laminated between said first ply and said second ply, and wherein each of said first ply and said second ply has a plurality of die-cut areas therein to define a plurality of spaced apart removable labels in each said ply.

15. A processable laminated form comprising a first ply of paper of rectangular shape;

a second ply of paper of rectangular shape permanently adhesively laminated to and co-extensive with said first ply;

said first ply having a plurality of die-cut areas therein to define a plurality of spaced apart removable labels in said first ply; and an adhesive disposed on only a portion of each respective label facing said second ply said adhesive being characterized in remaining on said respective label upon removal of said respective label from aid first ply to permit adhesion of said removed label to a substrate.

16. A processable laminated form as set forth in claim 15 wherein each ply is of an 8½ inch by 11 inch size.

17. A processable laminated form as set forth in claim 15 which further comprises a barrier layer at least between said adhesive-containing portion of each respective label and said second ply.

18. A processable laminated form as set forth in claim 17 which further comprises a fugitive glue between the remaining portion of each respective label and said second ply to releasably secure said respective label to said second ply.

19. A processable laminated form as set forth in claim 17 which further comprises a pressure-sensitive glue between the remaining portion of each respective label and said other ply to releasably secure said respective label to said other ply.

20. A processable laminated form as set forth in claim 15 wherein said second ply has a plurality of die-cut areas therein in off-set relation to said die-cut areas of said first ply to define a plurality of removable labels in said second ply.

21. A processable laminated form as set forth in claim 20 which further comprises a silicone barrier layer between said adhesive-containing portion of each respective label in said second ply and said first ply.

22. A processable laminated form as set forth in claim 15 wherein at least some of said die-cut areas are disposed in non-parallel relation to each other in said one ply to define labels at angles to each other.

23. A laminated form comprising a first ply of letter size;

a second ply permanently adhesively laminated to and co-extensive with said first ply;

said first ply having an image-receiving portion to receive message information therein and a plurality of die-cut areas therein separate from said image receiving portion to define a plurality of removable labels; and an adhesive disposed on only a portion of each respective label facing said second ply, said adhesive remaining on said respective label upon removal of said respective label from said first ply whereby said removed label is adherable to a substrate.

24. A laminated form as set forth in claim 23 wherein said die-cut areas are disposed along one longitudinal side of said first ply.

25. A laminated form as set forth in claim 24 wherein said die-cut areas are disposed along a lower half of said first ply.

26. A processable laminated form comprising a first ply;

a second ply laminated to said first ply;

at least one of said plies having a plurality of die-cut areas therein to define a plurality of removable labels in said one ply;

a removable pressure sensitive adhesive disposed on only a first portion of each respective label facing the other of said plies, said adhesive remaining on said respective label upon removal of said respective label from said one ply whereby said removed label is adherable to a substrate; and a fugitive glue between the remaining portion of each respective label and said other ply to releaseably secure said respective label to said other ply.

27. A processable form as set forth in claim 26 which further comprises a barrier layer between said adhesive-containing portion of each respective label and said other ply.

28. A processable laminated form comprising a first ply;

a second ply permanently adhesively laminated to said first ply;

at least one of said plies having a plurality of die-cut areas therein to define a plurality of removable labels in said one ply;

a removable pressure sensitive adhesive disposed on only a first portion of each respective label facing the other of said plies, said adhesive remaining on said respective label upon removal of said respective label from said one ply whereby said removed label is adherable to a substrate; and a pressure-sensitive glue between the remaining portion of each respective label and said other ply to releasable secure said respective label to said other ply.

29. A processable form as set forth in claim 28 which further comprises a barrier layer between said adhesive-containing portion of each respective label and said other ply.

30. A processable laminated form comprising a first ply of paper of rectangular shape;

a second ply of paper of rectangular shape laminated to and co-extensive with said first ply;

said first ply having a plurality of die-cut areas therein to define a plurality of removable labels in said first ply;

an adhesive disposed on only a portion of each respective label facing said second ply, said adhesive being characterized in remaining on said respective label upon removal of said respective label from said first ply to permit adhesion of said removed label to a substrate; and a fugitive glue between the remaining portion of each respective label and said second ply to releaseably secure said respective label to said second ply.

31. A processable laminated form comprising a first ply of paper of rectangular shape;

a second ply of paper of rectangular shape permanently adhesively laminated to and co-extensive with said first ply;

said first ply having a plurality of die-cut areas therein to define a plurality of removable labels in said first ply;

an adhesive disposed on only a portion of each respective label facing said second ply, said adhesive being characterized in remaining on said respective label upon removal of said respective label from said first ply to permit adhesion of said removed label to a substrate; and a pressure-sensitive glue between the remaining portion of each respective label and said other ply to releaseably secure said respective label to said other ply.

32. The combination of an imaging machine; and a processable laminated form for processing in said imaging machine, said form comprising a first ply having an image-receiving portion to receive message information during processing in said imaging machine and a plurality of die-cut areas separate from said image receiving portion to define a plurality of removable labels; a second ply permanently adhesively laminated to and co-extensive with said first ply; and an adhesive disposed on only a portion of each respective label facing said second ply, said adhesive remaining on said respective label upon removal of said respective label from said first ply whereby said removed label is adherable to a substrate.

* * * * *